United States Patent [19]

Goldhammer

[11] Patent Number: 4,625,925

[45] Date of Patent: Dec. 2, 1986

[54] COMMINUTING APPARATUS FOR SHEET MATERIAL OR SHEET MATERIAL LAYERS

[75] Inventor: Albert Goldhammer, Ueberlingen, Fed. Rep. of Germany

[73] Assignee: Feinwerktechnik Schleicher & Co., Fed. Rep. of Germany

[21] Appl. No.: 594,305

[22] Filed: Mar. 28, 1984

[30] Foreign Application Priority Data

Apr. 12, 1983 [DE] Fed. Rep. of Germany ..... 3313103

[51] Int. Cl.[4] ..... B02C 18/16

[52] U.S. Cl. ..... 241/236; 241/293

[58] Field of Search ..... 241/293, 294, 295, 166, 241/167, 235, 236

[56] References Cited

U.S. PATENT DOCUMENTS

| | | | |
|---|---|---|---|
| 1,980,193 | 11/1934 | Finegan | 241/236 X |
| 3,396,914 | 8/1968 | Liebman | 241/63 |
| 3,860,180 | 1/1975 | Goldhammer | 241/236 X |

FOREIGN PATENT DOCUMENTS

| | | | |
|---|---|---|---|
| 3305063 | 9/1983 | Fed. Rep. of Germany . | |
| 607690 | 9/1960 | Italy | 241/236 |
| 56627 | 6/1944 | Netherlands | 241/236 |
| 1392319 | 12/1972 | United Kingdom . | |

*Primary Examiner*—Mark Rosenbaum

*Attorney, Agent, or Firm*—Steele, Gould & Fried

[57] ABSTRACT

The cutting arrangement for a paper shredder consists of two cutting rolls with interengaging star-shaped cutting discs. The points of the teeth of the cutting wheels extend approximately up to the groove base of the grooves adjacent cutting discs on the other roll. The cutting rolls, which in each case are arranged synchronized "tooth to gap" have an effective intersection surface relative to one another the real overlap between them which is substantially smaller in area than the overall theoretical intersection surface, i.e. the lenticular overlap between the outer peripheral circles of the cutting discs.

18 Claims, 6 Drawing Figures

COMMINUTING APPARATUS FOR SHEET MATERIAL OR SHEET MATERIAL LAYERS

FIELD OF THE INVENTION

This invention relates to a cutting arrangement for apparatus for comminuting sheet or layer material to be comminuted, such as documents etc.

BACKGROUND OF THE INVENTION

Known comminution apparatus, particularly document shredders, generally have oppositely running cutting rolls with cutting discs intersecting with one another which act in the manner of a longitudinal cutter and which cut the material to be cut into long strips the width of which corresponds to the thickness of the discs. In order that the rollers better grasp the material to be comminuted, the cutting discs are partially roughened at their periphery. Furthermore at certain distances from one another cut-outs are provided at the periphery into which the material to be comminuted is drawn so that it is also torn in the transverse direction by being overstretched. There then arise relatively long, narrow particles.

It has already been proposed to construct the comminution rolls with cutting discs in the form of saw-plates i.e. with a saw toothing with each tooth having an essentially radial edge and an edge running out at a relatively flat angle. This relatively flat saw toothing in which the tooth pitch i.e. the distance of the apices from one another amounts to a multiple of the tooth height, was provided predominantly for better gripping of the material to be comminuted and the maximum intersection of the two outer circles of the cutting discs was likewise a multiple of the tooth height. With this apparatus, in which the cutting discs are not synchronised relative to one another, material to be comminuted is comminuted in undefined fashion.

The devices in accordance with the state of the art have a very substantial energy requirement and this not only during the cutting process but also when running empty.

OBJECT OF THE INVENTION

It is a principal object of the present invention to create a cutting arrangement for use e.g. in a document shredder which comminutes the material to be comminuted with low energy requirements but into particles of relatively small size.

GENERAL STATEMENT OF INVENTION

In accordance with the invention, the outer periphery of the cutting discs has cut-outs and each is offset by about half the peripheral cut-out spacing relative to the adjacent disc on the other roll, so that the real area of intersection between adjacent intermeshed cutting discs is at most half the theoretical lens-shaped area of intersection of the two outer peripheral circles of the two rollers.

In the invention accordingly on the one hand by synchronisation and adjustment care is taken that the teeth of both cutting discs work exactly on gaps of the other cutting disc and additionally the effective intersection surface is kept as small as possible, although the theoretical intersection surface can be chosen to be relatively large. This leads to the fact that a smaller energy requirement suffices to drive the cutting device, although the intersection dimension measured in the radial direction of the two cutting discs can be chosen quite large. Thereby good tearing off in the transverse direction arises so that it is ensured that the individual particles are separated from one another with certainty. This is particularly important for very tough extensible and resistant papers, for example plastics coated papers, as well as for plastics foils or the like. Additionally by the small effective intersection surface in comparison to the whole intersection surface wear is kept small. The ratio between effective and theoretical intersection surfaces can be les in a preferred embodiment than 0.4, preferably less than 0.3. Because of the small pressing in of the cut particles into the interspaces of the oppositely lying rolls, a lower pressing in force and stripping off force are required. With smaller effective intersection also the wedge angle, i.e. the angle between the two cutters during the longitudinal cutting process, is more acute and accordingly more favourable.

Advantageously the effective intersection surface can be an essentially zigzag shaped narrow band following the outer contour of the cutting disc, preferably over the greater part of its length less than a half, preferably less than a quarter of the maximum intersection wide. Thereby care is taken that the effective intersection surface is limited to the direct region of the cutting edges and follows their contour.

It is particularly advantageous if the maximum radial intersection dimension between the outer peripheral circles of the neighbouring cutting discs is less than three times, preferably less than twice the depth of the cut-out. Thereby a particularly favourable ratio is ensured between effective and theoretical intersection surfaces and additionally a substantial stretching of the material to be comminuted in the longitudinal direction. It is further of substantial advantage if the depth of the apertures is greater than a third, preferably greater than half of the peripheral distance between the cut-outs (pitch) thereby a particularly high extension for tearing apart tough materials is achieved.

Advantageously the part of the periphery of the cutting discs taken up by the apertures amounts to more than 90%, preferably more than 95% of the periphery of the cutting discs. Between the cut-outs in particular sharp edged apices can be formed at the periphery. Thereby it is achieved that the ratio of particle length which is determined by the peripheral distance between the cut-outs, and the respective amount of extension is an optimum. The sharp edged apices furthermore assist in promoting the longitudinal tearing off process and carry out this tearing off process at a defined position and with a defined tearing edge, so that the particles on the one hand are torn off with certainty and on the other hand are all of the same size and of the same shape, which makes clogging of the particles less of a problem.

Advantageously the cut-outs and the teeth formed between them have a symmetrical shape. This takes care of the fact that the superimposition of the cutting edges by the neighbouring cutting discs can be maintained as evenly wide as possible.

The cut-outs and the teeth formed between them can be of triangular shape. Approximation to triangular shape does not only take care that the teeth are as stable as possible, but also promotes an effective intersection surface of even width and good ratio between overlapping and surface area.

Advantageously the cut-outs of neighbouring cutting discs of the same cutting roll can be arranged relative to the cutting roll axis obliquely or in the shape of a helical line, wherein the helical lines on both cutting rolls run oppositely. Thereby the synchronisation between both cutting rolls is maintained (in each case tooth with gap) but there arises over the length of the cutting roll a varying cut which does not only take care that at one edge of the running in material to be comminuted a debris free cut starts, but it gives rise to an opposite toothing more closely described in what follows between the cutting rolls and the material to be comminuted which promotes optimum transport of the material to be comminuted. By the oblique toothing of the cutting rolls care is taken that the optimum entry conditions are present at least somewhere along the length of the cutting roll.

The depth of the grooves or slots between the cutting discs should only be a little larger than the maximum radial intersection dimension. If the distance between the apices formed at the outer periphery of the cutting roll and the base of the groove of the oppositely lying cutting roll is smaller than the maximum thickness of the material to be comminuted, and preferably amounts to less than 1 mm, these apices can, with particularly thick material to be comminuted which may give difficulties with tearing apart or with which the torn off particles still hang together locked into one another, act like a knife which cooperates with a counter-cutting surface. By corresponding adjustment of distance between the cutting rolls, a second cutting action can accordingly be achieved here, which however only comes to be effective if in fact it is a question of handling thicker materials which are not torn apart by themselves. With particles separated without difficulty in the transverse direction, the apex is without further ado free from the comminuted material, so that then this additional cutting action is not effective and does not need to be effective. For this purpose it is advantageous if the base of the groove runs with the cutting roll. In contrast to numerous constructions in which only the cutting discs run and intermediate spaces are constituted by fixed core parts of strippers, here accordingly the base of the groove can act as a co-running cutting anvil, which simultaneously also transports the particles from the cutting zone. Strippers or ejectors are however provided. They engage from outside into the grooves between the cutting discs.

The cutting rolls can be made in one piece with the cutting discs. In contrast to the construction of individual cutting discs stamped out of sheet metal and arranged on a shaft, mounting is thereby substantially less troublesome. Because of the fact that the roll core runs round with the cutting discs, friction is avoided which arises with constructed rolls with fixed stripper distance pieces.

In order that the number of cut-outs on the periphery can be very large and preferably amount to over 15, one seeks to secure a particularly small particle size. Furthermore it has been shown that the transport properties i.e. the grip of material to be comminuted with automatic feeding in into the cutting nip with the cutting device in accordance with the invention is particularly good. Also the feeding away of particles is favoured by the shape of the cutting rolls.

Also the longitudinal cut which is carried out by the cooperating cutting edges of the cutting discs on both cutting rolls is improved, since because of the strong shaping of the outer periphery of the cutting rolls the cutting edges are elongated and accordingly a drawing cut with differing cutting angles and cutting speeds arises. By virtue of the fact that sharp apices work against the groove base, no cut material can clog up between both cutting rolls while with normal cutting devices care was always taken to give a large distance between core and oppositely lying cutting disc in order with certainty to pull through the paper.

It has furthermore been determined that the cutting device runs particularly quietly and without "hacking". The cutting property is also accordingly particularly good since the cutting material is held firmly right up to the final separation of each particle from the strongly shaped mutually cooperating cutting discs.

DESCRIPTION OF PREFERRED EMBODIMENT

Figure 1:
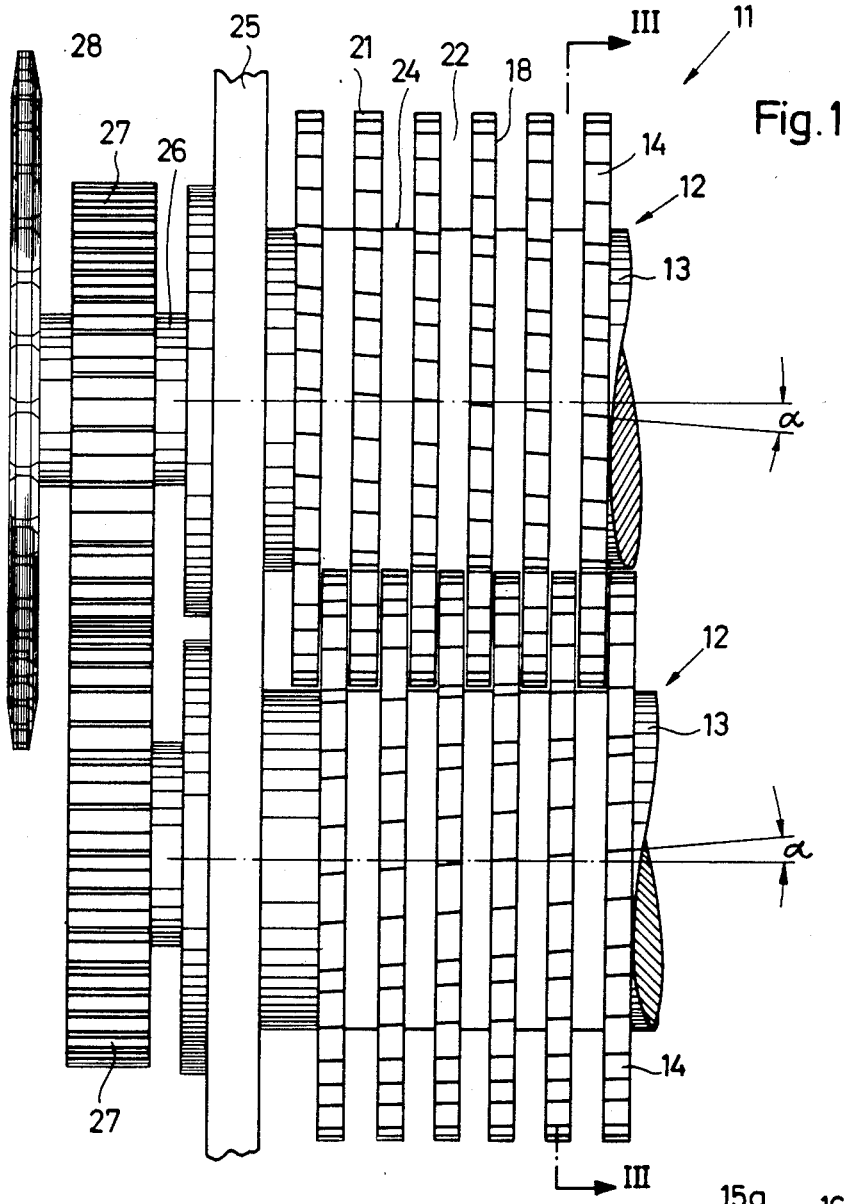

Features of preferred constructions are evident from the following description in connection with the drawings, wherein these features and the individual features of the sub-claims can be realised by themselves or more than one in the form of sub-combinations in an embodiment of the invention. In the drawing FIG. 1 shows an enlarged view of a part of a cutting device in accordance with an exemplary embodiment of the invention, FIGS. 2 and 3 are schematic partial sections according to the line II-III in FIG. 1.

Figure 6:
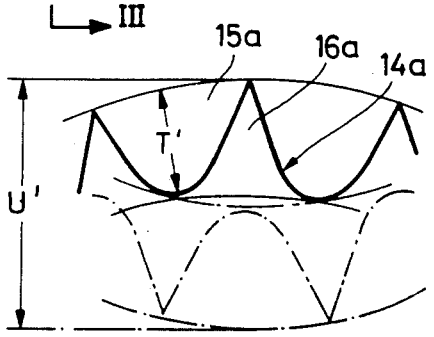
Figure 2:
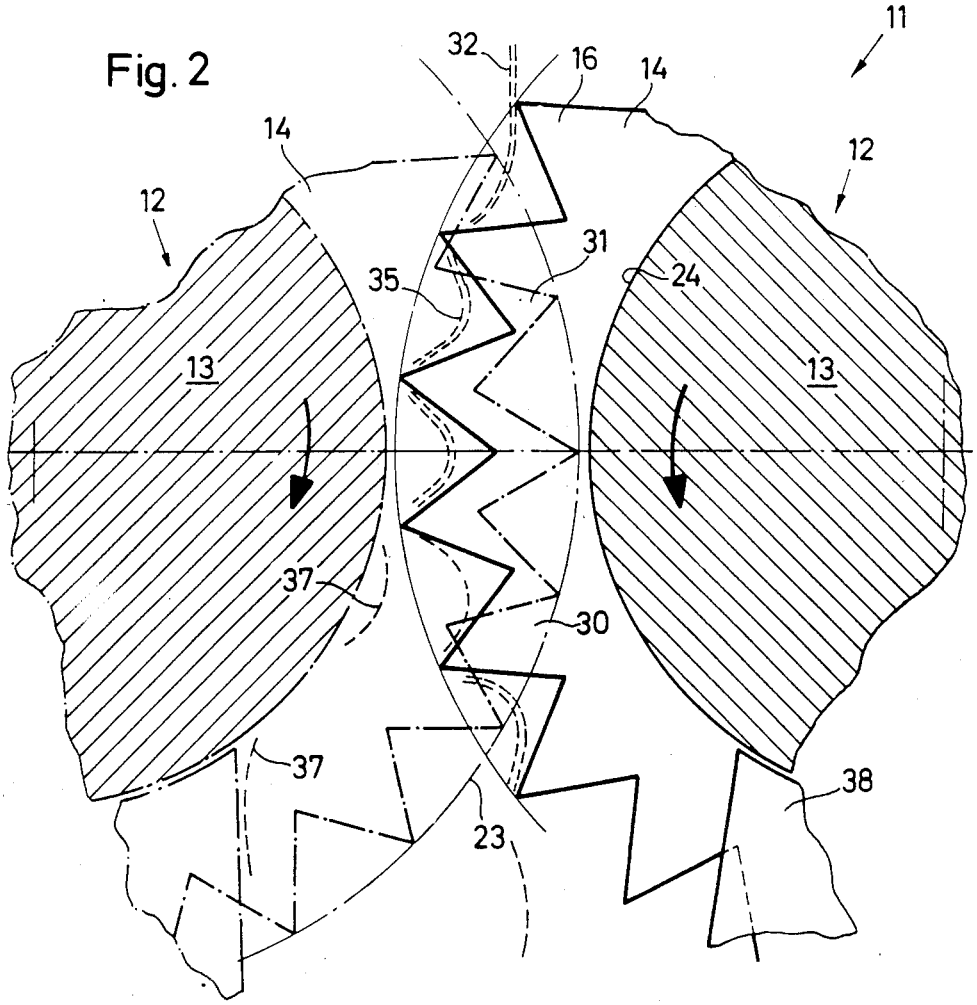
Figure 5:
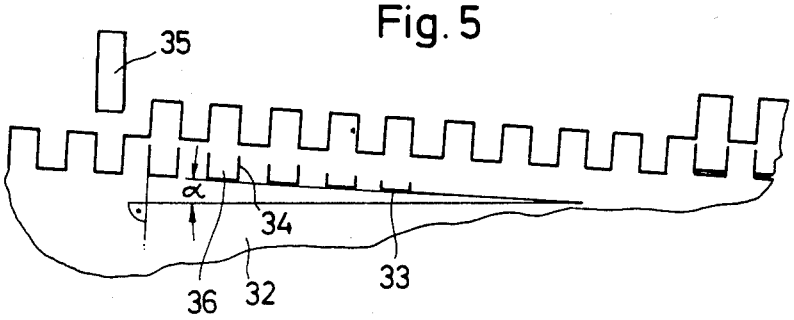
Figure 4:
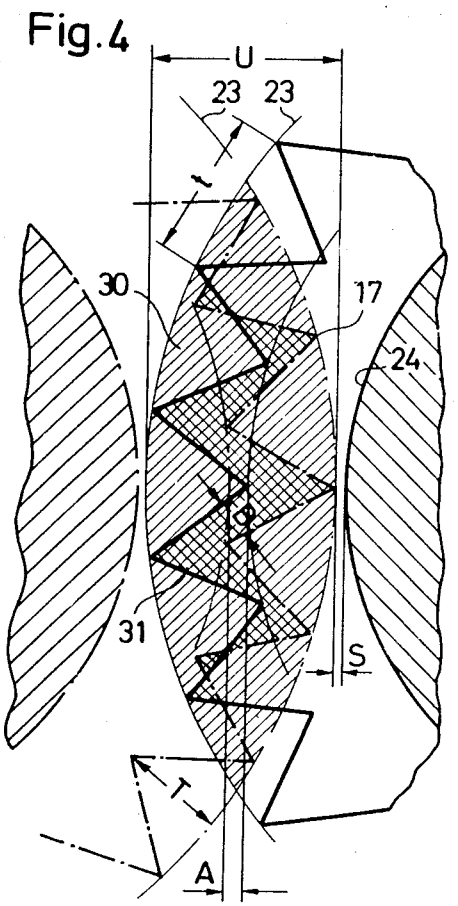
Figure 3:
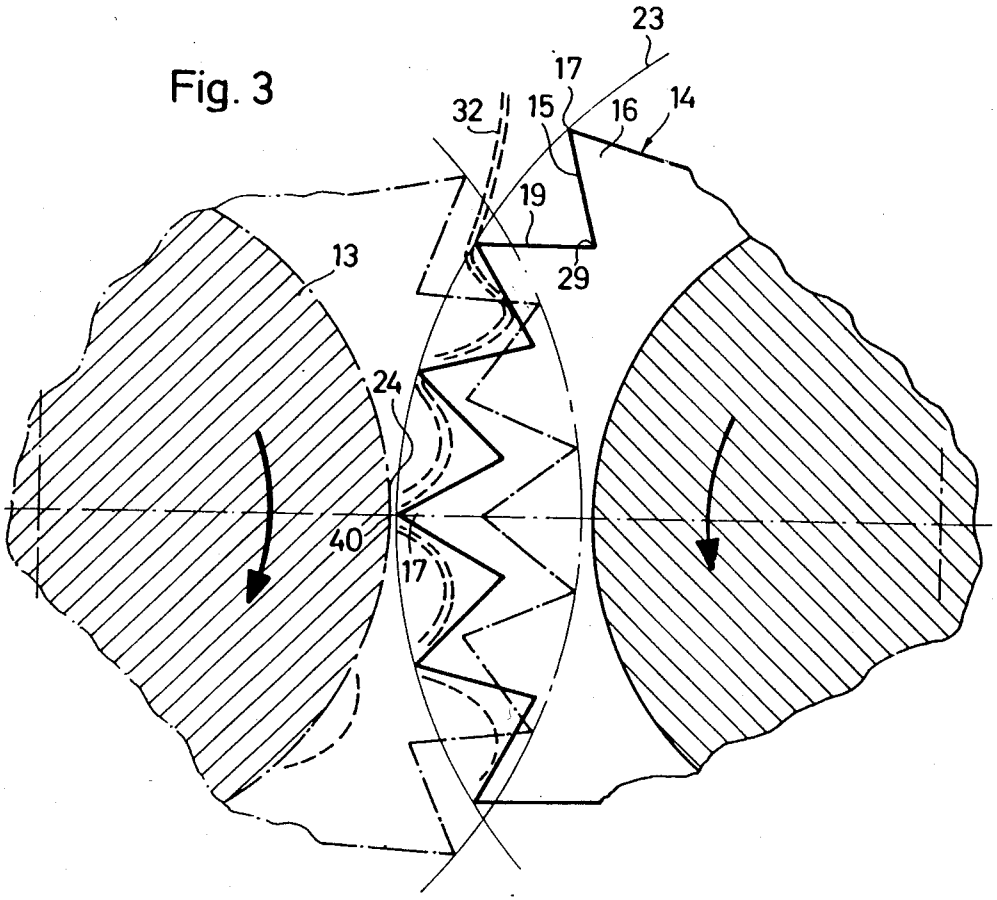

FIG. 4 is a schematic drawing similar to FIG. 2 and 3 with illustration of the characteristic distances and areas, FIG. 5 shows the cutting edge of material to be comminuted and FIG. 6 shows the tooth shape in another embodiment.

FIG. 1 shows a detail of a cutting arrangement 11 for a document shredder or the like i.e. an apparatus with which sheet materials or sheet material layers can be cut into particles of the smallest possible size. The cutting arrangement 11 has two cutting rolls 12 which in the present exemplary embodiment are manufactured in one piece and which consist of a core 13 in the form of a continuous shaft and cutting discs 14 standing out radially therefrom, which have the form of relatively narrow radial flanges the axial distance of which from one another is only insubstantially greater than their axial thickness. The length of the cutting roll amounts normally to a multiple of its diameter. Although these cutting rolls at their outer periphery are strongly shaped, they can also be made of individual discs and distance pieces laid between them and in the present example the cutting discs are formed as one piece flanges, they are in connection with the invention denoted as cutting rolls and cutting discs.

The cutting discs 14 have at their outer periphery a shaping in the form of triangular cut-outs 15 which are directly adjacent one another and between which likewise form triangular shaped teeth 16, which have straight line sides and which end with a sharp edged apex 17. The side or end surfaces 18 directed in the axial direction of the cutting discs are plane parallel and the tooth edges 19 as well as the angle of the apex 17 run essentially in the axial direction. Numerous teeth or cut-outs are provided at the periphery of each cutting disc 14 and indeed preferably more than 15 and in the exemplary embodiment illustrated over 20. The depth T of the cut-outs is not substantially smaller than their pitch t, i.e. the peripheral distance between the apices 17

(FIG. 4). Thereby relatively pointed teeth 16 and correspondingly deep cut-outs arise.

The cut-outs or apices of each cutting disc are aligned relative to one another in such a way that they form a steep helical line, the inclination of which lies as a order of magnitude about 50 times that of the diameter. Thereby they form an angle relative to the axis 20 of the cutting roll of about 5°. The obliqueness or helical line of both cutting rolls runs oppositely.

The cutting rolls form on both sides of their peripheral contour i.e. the flanks 19, cutting edges 21 which cooperate with the cutting edges on the cutting discs of the other cutting roll 12. For this the cutting discs engage in each case in the groove 22 between two cutting discs of the other cutting roll and do this to such an extent that the distance S of the apex or of the outer peripheral circle 23 connecting the apices from the base of the groove 24 is very small and preferably amounts to less than 1 mm. The base of the groove 24 is the outer periphery of the core 13.

Both cutting rolls 12 are rotatably mounted in a framework 25 and carry on their shaft ends 26 interengaging toothed cog wheels 27 which ensure that the cutting rolls run oppositely with the same rotational speed and the teeth and cut-outs are so arranged relative to one another that in each case a tooth of one cutting disc relative to the corresponding teeth of the neighbouring cutting disc of the oppositely lying cutting roll is offset by a half pitch t i.e. in each case "tooth meets gap". In this connection naturally care is taken that in each case neighbouring teeth are offset relative to one another somewhat on account of the helix angle $\alpha$. If desired between at least one of the toothed cogs and the shaft a not illustrated adjustment device can be provided in order to be able to undertake registering of the cutting rolls. The drive to the cutting rolls can take place via a sprocket 28 and a not illustrated chain by means of an electric motor.

From FIG. 4 it is still evident that the mutual engagement of the cutting discs 14 in one another takes place over the overall intersection distance U which smaller by the relatively small amount of twice S than the distance of the two cores 13 from one another, so that each tooth apex 17 runs at a relatively small distance from the groove base 24. The intersection dimension U is in the illustrated example less than twice as large as the tooth height or cut-out depth T, so that between the base 29 of the cut-outs 15 likewise an intersection is present of the dimension A in FIG. 4.

In FIGS. 2 to 4 the intersection relationships are illustrated. In this connection for clarity of illustration in each case the lines belonging to one of the cutting rolls (the right-hand one) are drawn continuously, while the lines belonging to the other (left) cutting roll are drawn dash-dot. FIG. 4 shows that the simply hatched lens-shaped theoretical intersection area 30, which forms between the two outer peripheral circles 23, is substantially greater than the effective intersection surface 31 which is cross-hatched, that is those areas where the outer surfaces 18 of neighbouring cutting discs in fact lie against one another or are at a minimum distance from one another. With the exemplary embodiment illustrated the effective intersection surface 31 only amounts to about 30% of the theoretical intersection surface 30. This amount can with corresponding optimisation of the shape and arrangement of the cutting discs be brought to under 25%, without the width B of the effective intersection surface being too small still to guarantee satisfactory cutting between the cutting edges of both cutting discs. Overall the effective intersection surface has the shape of a zigzag shaped band which follows the tooth contour. The synchronisation of both cutting rolls "tooth to gap" takes care that despite the tooth base intersection A, the effective intersection surface forms a continuous strip.

The described cutting device works in accordance with the following process:

Material 32 to be comminuted, for example one or several sheets of paper, indicated by a double dashed line, is brought between the cutting rolls, for example via an introduction slot from above. In FIGS. 2 to 3 only that part of the material to be comminuted is illustrated which runs in the plane of the right-hand cutting disc 14 drawn in full lines. The track in the plane which belongs to the cutting discs belonging to the left-hand cutting roll (dash-dot lines) is correspondingly mirror-imaged thereto. The actual longitudinal and transverse cutting process takes place in the region of the inlet i.e. in the upper part in FIG. 2 and 3. The teeth 16 of the cutting disc engage the material 32 to be comminuted, bend it into the oppositely lying cut-out of the other cutting disc and push through the material to be comminuted which is practically tensioned between the teeth finally with the point so that, as is evident from FIG. 5, the cutting process starts with the transverse cut 33. The tooth then goes further into the material 32 to be comminuted and completes then the cross cut 33 by increasingly lengthening longitudinal cuts which form a U-shaped cutting line, the legs of which are finally cut through up to the edge of the material so that a particle 35 arises which has the form of a longitudinally extended substantially rectangular parallelogram.

The longitudinal cut is carried out by the cutting edges 21 which are formed on the tooth edges 19. In FIG. 5 the individual phases of the cutting process are well evident in their sequence running from right to left, because as a result of the steeply helically shaped arrangement of the teeth relative to one another the individual cutting processes with neighbouring cutting discs are carried out not simultaneously but successively. Correspondingly the cutting line is also however stepped obliquely offset by the angle $\alpha$, so that after a certain number of cutting discs the same process is repeated. It should be still mentioned that the tabs 36 (FIG. 5) which arise because of the transverse cuts 33 and the longitudinal cuts 34 are bent out from the plane of the material 32 to be comminuted, so that the particles have a kink. The teeth 16 engage in the holes formed as in perforations and accordingly pull the material to be comminuted by positive engagement between the rollers. Because of the oblique arrangement and the perforations which repeat at a certain distance, the material to be comminuted is not only pulled in with certainty and straight, but also so tensioned in the axial direction of the cutting rolls that the longitudinal cutting is carried out in a particularly trouble-free and clean fashion. One can see that each particle 35 is cut out by two U-shaped cuts offset relative to one another by a cutting disc width which run outwards from the interior of the material to be comminuted to the rim edge. The material is accordingly tensioned during the whole of the cutting.

The individual particles 35 are then transported in the cut-outs 15 or by the teeth 16 and fall out from this on the oppositely lying side. It is overall possible that particles of portions 37 of a particle layer sit in the groove 22 between two cutting discs and run round with this. For this purpose fixed strippers 38 are provided which run on the groove base 24 and strip out the particles from the groove 22.

In FIG. 3 it is shown how the next toothed roller relative to FIG. 2 starts its engagement. It is also evident there that in the case that a very thick layer of material to be comminuted were introduced, in which the transverse cut 33 would not extend through the whole layer, this transverse cut is completed by the cooperation of the apex 17 with the oppositely lying groove base 24, wherein also this additional cutting process goes very smoothly, since the cutting gap 40 arising as they approach one another between the apex 17 and the base of the groove 24 closes very slowly. It is accordingly very advantageous that the adjustment of this cutting slot 40 i.e. of the distance S, should not take place too closely, because this additional cutting process has to assist with support only with thick layers, while thinner layers reach this cutting cleft already separated through and accordingly effectively do not run through the cutting slot. In the cutting slot 40 the cooperating parts i.e. the apex 17 and the base of the groove 24 run with different peripheral speeds, which promotes the comminution action.

FIG. 6 shows a variation of the outer contour of the cutting discs 14*a*. In this case the cut-outs have a shape with a rounded base and it can be part of a parabola, cycloid or a circular arc, appropriately with extending slopes. Such shapes can be made by a roller milling process. With this embodiment additionally there is no tooth space over cutting i.e. the depth T of the cut-outs 15*a* is somewhat less than half as great as the maximum intersection U'. Despite this there arises a narrow zigzag shaped band of the intersection surface. The rounding of the base of the teeth can work favourably on a continuous run of the effective intersection surface, so that multiple dipping in and out of the teeth from mutual engagement can be avoided. The teeth 16*a* are somewhat more pointed than with the triangular construction.

By means of the invention it is possible with a relatively small overall intersection U to achieve a substantial extension of the material to be comminuted and thereby a certain tearing off. Thereby also the manufacture of the cutting rolls is simplified.

I claim:

1. A cutting arrangement for comminuting sheet material, comprising:

two cutting rolls rotatable around parallel axes in a common connecting plane, the rolls being drivable in opposite directions around said axes, each cutting roll having a plurality of cutting discs spaced from one another by a groove, the cutting rolls being spaced such that the cutting discs intersect one another, each disc between end discs of the rolls engaging in the groove between adjacent cutting discs on the other of said cutting rolls, each cutting disc having an outer periphery and two side faces, the outer periphery being provided with cut-outs, adjacent cut-outs on each of the discs defining teeth having apices and bottoms between the teeth, cutting edges on each cutting disc being defined by the teeth and the side faces;

means for driving said cutting rolls in rotational synchronism, and the cutting rolls being rotationally offset with respect to one another by an angular offset of about half a circumferential distance between cut-outs, whereby each tooth of each cutting disc on one cutting roll is substantially aligned with a cut-out of said adjacent cutting discs of the other cutting roll as the rolls are rotated around said axes, the bottoms betweens the teeth on each cutting disc travel during rotation in a circle which does not intersect the bottoms circle of travel of the other disc; and, said teeth and the cutting edges defining an effective intersecting surface between adjacent side faces of each cutting disc in which area the cutting discs and the opposing teeth are very closely adjacent one another, said effective intersecting surface being a narrow zigzag-shaped band following an outer circumference of each cutting disc and continuous over at least two of said teeth, whereby at least two teeth on both cutting discs work exactly on gaps of the outer cutting disc.

2. The cutting arrangement of claim 1 wherein the ratio between effective and theoretical intersection surfaces is less than 0.4.

3. The cutting arrangement of claim 1, wherein the real intersecting surface is, over a greater part of its length, less than half as wide as a maximum amount of intersection.

4. The cutting arrangement of claim 3, wherein the real intersecting surface is less than a quater of the maximum amount of intersection.

5. The cutting arrangement of claim 3, wherein the real intersecting surface, over a greater part of its length, is less than half as wide as a maximum theoretical intersection.

6. The cutting arrangement of claim 1 wherein the maximum radial intersection between the cutting discs is less than three times a radial depth of the cut-outs.

7. The cutting arrangement of claim 1 wherein the cut-outs have a depth greater than a third of a peripheral distance between the cut-outs around an outer circumference of the cutting rolls.

8. The cutting arrangement of claim 7, wherein the depths of the cut-outs are greater than half the perepheral distance between the cut-outs.

9. The cutting arrangement of claim 1, wherein at least 90% of the outer periphery of the cutting discs is taken up by the cut-outs.

10. The cutting arrangement of claim 9 wherein the cut-outs and the teeth formed between them have a symmetric shape.

11. The cutting arrangement of claim 9, wherein the cut-outs define sharp angles at the periphery of the cutting discs.

12. The cutting arrangement of claim 1 wherein the cut-outs and the teeth formed between them are triangular shaped.

13. The cutting arrangement of claim 1, wherein the cut-outs of adjacent cutting discs of each cutting roll are arranged obliquely relative to the axis of said cutting roll, defining a helix line for said cutting roll and wherein the helix lines on the two cutting rolls run oppositely.

14. The cutting arrangement of claim 1 wherein the radial depth of the grooves between the cutting discs is greater than the maximum radial intersection amount by a minimal clearance.

15. The cutting arrangement of claim 1, wherein the apices at the outer periphery of one cutting roll are spaced from the bottom of the groove of the cutting roll by less than a maximum thickness of material to be comminuted.

16. The cutting arrangement of claim 1 wherein a groove base runs with the cutting roll.

17. The cutting arrangement of claim 1 wherein each cutting roll is manufactured in one piece with the cutting discs.

18. The cutting arrangement of claim 11 wherein the number of cut-outs on the periphery amounts to more than 15.

* * * * *